US009651910B2

(12) United States Patent
Kosuge et al.

(10) Patent No.: US 9,651,910 B2
(45) Date of Patent: May 16, 2017

(54) IMAGE FORMING APPARATUS INCORPORATING LINE SENSOR

(71) Applicants: Akio Kosuge, Kanagawa (JP); Natsumi Matsue, Kanagawa (JP); Keiko Matsumoto, Kanagawa (JP); Akira Yoshida, Tokyo (JP); Yoichi Sakurai, Kanagawa (JP); Yuuichiroh Uematsu, Kanagawa (JP); Kohta Fujimori, Kanagawa (JP); Kayoko Tanaka, Tokyo (JP)

(72) Inventors: Akio Kosuge, Kanagawa (JP); Natsumi Matsue, Kanagawa (JP); Keiko Matsumoto, Kanagawa (JP); Akira Yoshida, Tokyo (JP); Yoichi Sakurai, Kanagawa (JP); Yuuichiroh Uematsu, Kanagawa (JP); Kohta Fujimori, Kanagawa (JP); Kayoko Tanaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/190,685

(22) Filed: Jun. 23, 2016

(65) Prior Publication Data

US 2016/0378040 A1 Dec. 29, 2016

(30) Foreign Application Priority Data

Jun. 29, 2015 (JP) ..... 2015-129988
Nov. 25, 2015 (JP) ..... 2015-229591

(51) Int. Cl.
*G03G 15/00* (2006.01)
*G03G 15/01* (2006.01)

(52) U.S. Cl.
CPC ..... *G03G 15/556* (2013.01); *G03G 15/01* (2013.01); *G03G 15/5058* (2013.01)

(58) Field of Classification Search
USPC ..... 399/38, 42, 46, 49, 72, 74
See application file for complete search history.

(56) References Cited

U.S. PATENT DOCUMENTS 5,973,795 A * 10/1999 Iida ..... G03G 15/5062 399/59
7,680,425 B2 * 3/2010 Hama ..... H04N 1/4078 399/49

(Continued)

FOREIGN PATENT DOCUMENTS

JP 2006-139179 6/2006
JP 2010-072195 4/2010

(Continued)

OTHER PUBLICATIONS

U.S. Appl. No. 15/052,272, filed Feb. 24, 2016, Natsumi Matsue, et al.

(Continued)

*Primary Examiner* — Hoan Tran
(74) *Attorney, Agent, or Firm* — Oblon, McClelland, Maier & Neustadt, L.L.P.

(57) ABSTRACT

An image forming apparatus includes an image bearer, an image forming device to form a toner image on the image bearer, a transfer device to transfer the toner image to a recording medium, a line sensor as an image density sensor to detect image density of the toner image, and a controller operatively connected to the image density sensor. The image density sensor is disposed so as to be shorter in a rotational direction of the image bearer than in a width direction of the image bearer perpendicular to the rotational direction of the image bearer. The controller forms a shading pattern image including a plurality of patches on the image bearer, and detects image density of the plurality of patches, so as to control image density. The shading pattern image is (Continued)

shorter in the rotational direction of the image bearer than in the width direction of the image bearer.

16 Claims, 12 Drawing Sheets

(56) References Cited

U.S. PATENT DOCUMENTS

| | | | | |
|---|---|---|---|---|
| 9,146,498 | B2 * | 9/2015 | Komatsu ..... | G03G 15/0849 |
| 2013/0004188 | A1 | 1/2013 | Suzuki | |
| 2013/0236200 | A1 | 9/2013 | Tanaka et al. | |
| 2015/0015923 | A1 | 1/2015 | Hayashi | |

FOREIGN PATENT DOCUMENTS

| | | | |
|---|---|---|---|
| JP | 2010-152132 | | 7/2010 |
| JP | 2011-109394 | A | 6/2011 |
| JP | 2013-218284 | | 10/2013 |
| JP | 2014-240950 | | 12/2014 |
| JP | 2015-018170 | | 1/2015 |

OTHER PUBLICATIONS

U.S. Appl. No. 15/274,366, filed Sep. 23, 2016, Natsumi Matsue, et al.

* cited by examiner

IMAGE FORMING APPARATUS INCORPORATING LINE SENSOR

CROSS-REFERENCE TO RELATED APPLICATIONS

This patent application is based on and claims priority pursuant to 35 U.S.C. §119(a) to Japanese Patent Application Nos. 2015-129988, filed on Jun. 29, 2015, and 2015-229591, filed on Nov. 25, 2015, in the Japan Patent Office, the entire disclosure of each of which is hereby incorporated by reference herein.

BACKGROUND

Technical Field

Embodiments of the present disclosure generally relate to an image forming apparatus incorporating a line sensor.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly or indirectly via an intermediate transfer belt. Finally, a fixing device applies heat and pressure to the recording medium carrying the toner image to fix the toner image onto the recording medium. Thus, the image is formed on the recording medium.

Such image forming apparatuses often include a line sensor as an image density sensor that detects image density of a plurality of patches of a shading pattern image formed on the surface of an image bearer.

SUMMARY

In one embodiment of this disclosure, a novel image forming apparatus is described that includes an image bearer, an image forming device to form a toner image on the image bearer, a transfer device to transfer the toner image from the image bearer to a recording medium, a line sensor as an image density sensor to detect image density of the toner image on the image bearer, and a controller operatively connected to the image density sensor. The image density sensor is disposed so as to be shorter in a rotational direction of the image bearer than in a width direction of the image bearer perpendicular to the rotational direction of the image bearer. The controller forms a shading pattern image including a plurality of patches subject to detection on an outer circumferential surface of the image bearer with the image forming device, and detects image density of the plurality of patches of the shading pattern image with the image density sensor, so as to control image density. The shading pattern image is shorter in the rotational direction of the image bearer than in the width direction of the image bearer.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
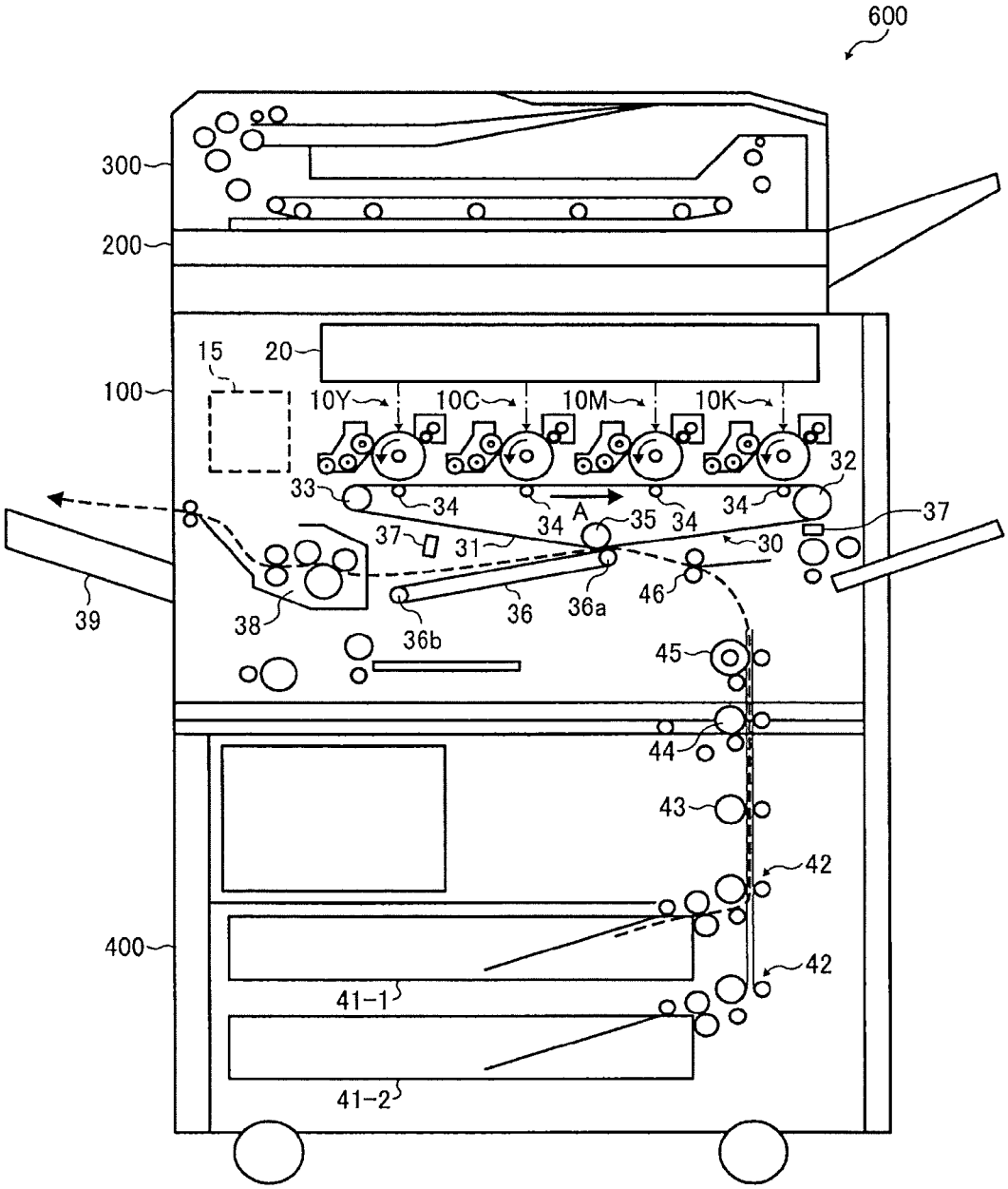
FIG. 1 is a schematic view of an image forming apparatus according to an embodiment of the present disclosure.

The accompanying drawings are intended to depict embodiments of this disclosure and should not be interpreted to limit the scope thereof.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable to this disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of this disclosure are described below.

It is to be noted that, in the following description, suffixes Y, C, M, and K denote colors yellow, cyan, magenta and black, respectively. To simplify the description, these suffixes are omitted unless necessary.

Figure 2:
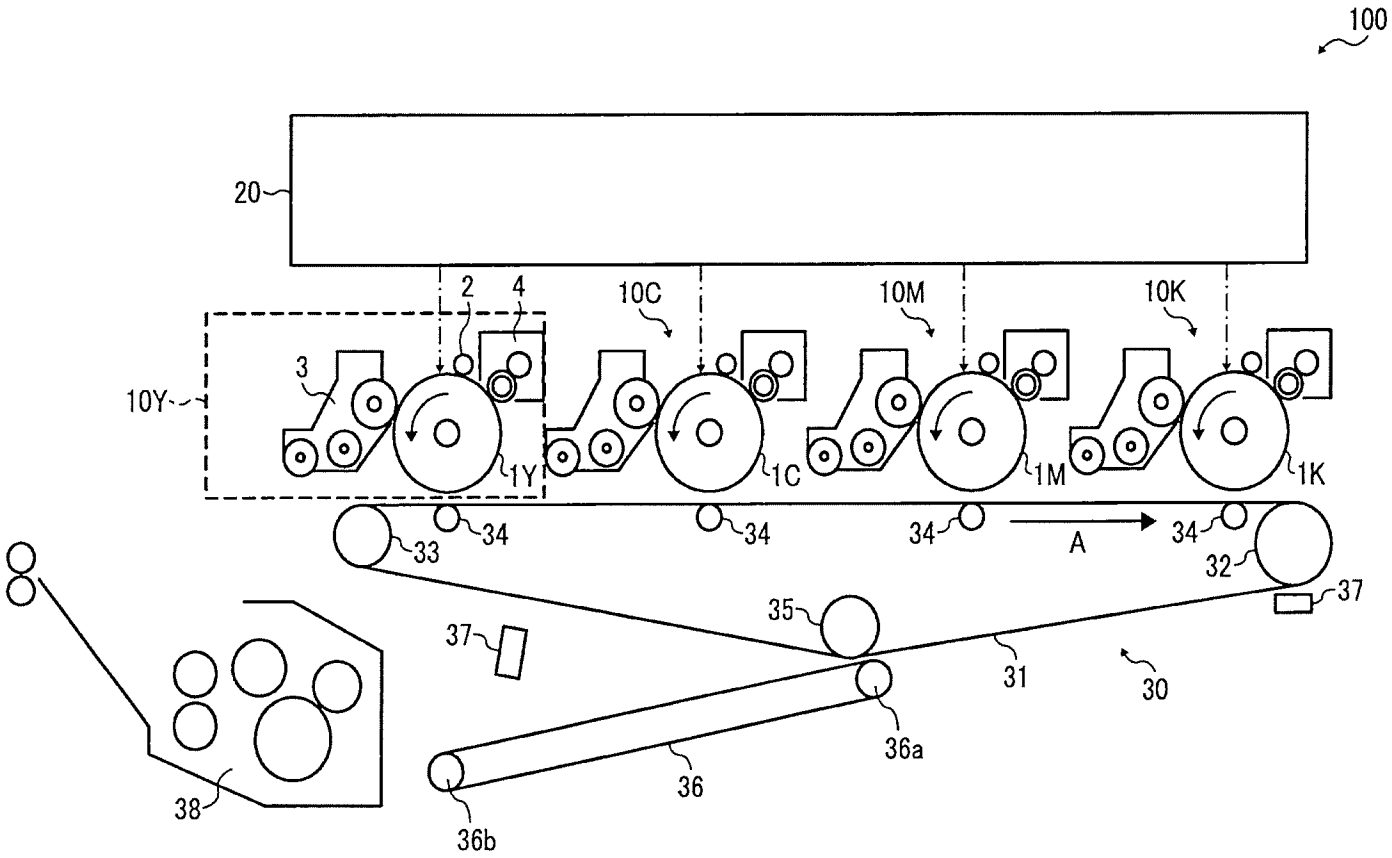
FIG. 2 is a partially enlarged view of the image forming apparatus of FIG. 1, particularly illustrating an image forming unit.

Initially with reference to FIGS. 1 and 2, a description is given of a configuration of an electrophotographic image forming apparatus 600 according to an embodiment of the present disclosure.

FIG. 1 is a schematic view of the image forming apparatus 600. FIG. 2 is a partially enlarged view of the image forming apparatus 600, particularly illustrating an image forming unit 100.

The image forming apparatus 600 includes, e.g., the image forming unit 100 to form an image on a recording medium, a sheet feeder 400 serving as a recording medium supplier to supply the recording medium to the image forming unit 100, a scanner 200 serving as an image reader to read an image of a document to generate image data, and an automatic document feeder (ADF) 300 serving as a document feeder to automatically supply the document to the scanner 200.

Inside the image forming unit 100, a transfer unit 30 is disposed. The transfer unit 30 includes an endless intermediate transfer belt 31 serving as an image bearer and a plurality of rollers that support the intermediate transfer belt 31. The intermediate transfer belt 31 is entrained around the plurality of rollers and formed into an endless loop. Specifically, the plurality of rollers include a drive roller 32 rotated by a driver, a driven roller 33, a secondary-transfer backup roller 35 and four primary transfer rollers 34.

The intermediate transfer belt 31 is made of, e.g., a resin material having low elasticity, such as polyimide, in which carbon powder is dispersed to adjust electrical resistance. As the drive roller 32 rotates, the intermediate transfer belt 31 is rotated in a clockwise direction (hereinafter referred to as belt rotating direction) indicated by arrow A in FIG. 1 while being supported by the plurality of rollers disposed inside the loop of the intermediate transfer belt 31.

Each of the four primary transfer rollers 34 is applied with a primary transfer bias output from a primary transfer power source. The intermediate transfer belt 31 is sandwiched between the four primary transfer rollers 34 and opposing drum-shaped photoconductors 1Y, 1C, 1M and 1K serving as latent image bearers. Thus, four primary transfer areas herein called primary transfer nips are formed between the intermediate transfer belt 31 and the photoconductors 1Y, 1C, 1M and 1K. Toner images of yellow, cyan, magenta and black formed on the respective surfaces of the photoconductors 1Y, 1C, 1M and 1K are primarily transferred on an outer circumferential surface of the intermediate transfer belt 31 at the respective primary transfer nips. Above the transfer unit 30 is four imaging units 10Y, 10C, 10M and 10K that respectively include the photoconductors 1Y, 1C, 1M and 1K.

Above the imaging units 10Y, 10C, 10M and 10K is an optical writing unit 20 serving as a latent image writing device. The optical writing unit 20 includes four laser diodes (LDs) driven by a laser controller to emit four laser beams as writing light according to image data including, e.g., an input image to be output.

In addition to the laser diodes serving as light sources, the optical writing unit 20 includes, e.g., light deflectors such as polygon mirrors, reflection mirrors and optical lenses. In the optical writing unit 20, the laser beams emitted by the laser diodes are deflected by the light deflectors, reflected by the reflection mirrors and pass through the optical lenses to finally reach the surfaces of the photoconductors 1Y, 1C, 1M, and 1K. Thus, the optical writing unit 20 scans the surfaces of the photoconductors 1Y, 1C, 1M, and 1K to write electrostatic latent images on the surfaces of the photoconductors 1Y, 1C, 1M, and 1K. Alternatively, the optical writing unit 20 may include a light emitting diode (LED) array as a light source.

As illustrated in FIG. 2, the imaging units 10Y, 10C, 10M and 10K respectively include the photoconductors 1Y, 1C, 1M and 1K as described above. Additionally, each of the imaging units 10Y, 10C, 10M and 10K includes, e.g., a charging device 2, a developing device 3 and a cleaning device 4 surrounding the photoconductor 1. It is to be noted that, in FIG. 2, reference numerals 2 through 4 are respectively assigned to the charging device, the developing device and the cleaning device of the imaging unit 10Y only. Since the imaging units 10Y, 10C, 10M and 10K have identical configurations differing only in the color of toner, reference numerals for the imaging units 10C, 10M and 10K are omitted. The photoconductor 1 is rotated in a counterclockwise direction in FIG. 2, and reaches a position opposite the charging device 2, where the surface of the photoconductor 1 is uniformly charged. Then, the optical writing unit 20 irradiates the uniformly charged surface of the photoconductor 1 with the writing light to form an electrostatic latent image thereon.

The developing device 3 develops the electrostatic latent image formed on the surface of the photoconductor 1 with toner borne by a developing roller serving as a developer bearer into a visible toner image. The photoconductor 1 and the developing roller are rotatable and face each other with a predetermined gap, herein called a developing gap, therebetween. The cleaning device 4 removes residual toner from the surface of the photoconductor 1 after a primary-transfer process in which the toner image is transferred onto the intermediate transfer belt 31.

Specifically, the toner images formed on the surfaces of the photoconductors 1Y, 1C, 1M, and 1K are sequentially transferred onto the outer circumferential surface of the intermediate transfer belt 31 while being superimposed one atop another. Thus, a composite color toner image is formed on the intermediate transfer belt 31.

As illustrated in FIGS. 1 and 2, the secondary-transfer backup roller 35 faces a roller 36*a*. A conveyor belt 36 is entrained around the roller 36*a* and a roller 36*b*, and formed into an endless loop. Between the secondary-transfer backup roller 35 and the roller 36*a*, the intermediate transfer belt 31 comes into contact with the conveyor belt 36, thereby forming an area of contact herein called a secondary transfer nip between the intermediate transfer belt 31 and the conveyor belt 36.

Referring back to FIG. 1, the sheet feeder 400 includes, e.g., a plurality of vertically disposed sheet-feeding trays 41-1 and 41-2. A recording medium is fed from one of the sheet-feeding trays 41-1 and 41-2 to a recording medium conveyance passage 42. The recording medium is then conveyed to a registration roller pair 46 via conveyor roller pairs 43 through 45. The registration roller pair 46 is timed to rotate to send the recording medium such that the recording medium is aligned with the composite color toner image formed on the intermediate transfer belt 31 at the secondary transfer nip at which the intermediate transfer belt 31 and the conveyor belt 36 meet. Specifically, the yellow, cyan, magenta and black toner images constituting the composite color toner image are together transferred onto the recording medium by pressure generated at the secondary transfer nip and a secondary transfer electrical field generated by a secondary transfer bias, which is applied to the secondary-transfer backup roller 35. Thus, a full-color toner image is formed on the recording medium.

After passing through the secondary transfer nip, the recording medium is conveyed on the conveyor belt 36 to a fixing device 38 as the conveyor belt 36 rotates. In the fixing device 38, the full-color image is fixed on the recording medium by heat and pressure generated at an area of contact herein called a fixing nip between two rotary bodies of the fixing device 38. Finally, the recording medium bearing the fixed toner image is ejected onto an ejection tray 39 provided outside the image forming unit 100.

As illustrated in FIG. 1, the image forming apparatus 600 includes a controller 15. The controller 15 is implemented as a central processing unit (CPU) such as a microprocessor to perform various types of control described later, and provided with control circuits, an input/output device, a clock, a timer, and a storage unit 606 including both nonvolatile memory and volatile memory. The storage unit 606 stores various types of control programs and information such as outputs from sensors and calculation data.

Figure 3:
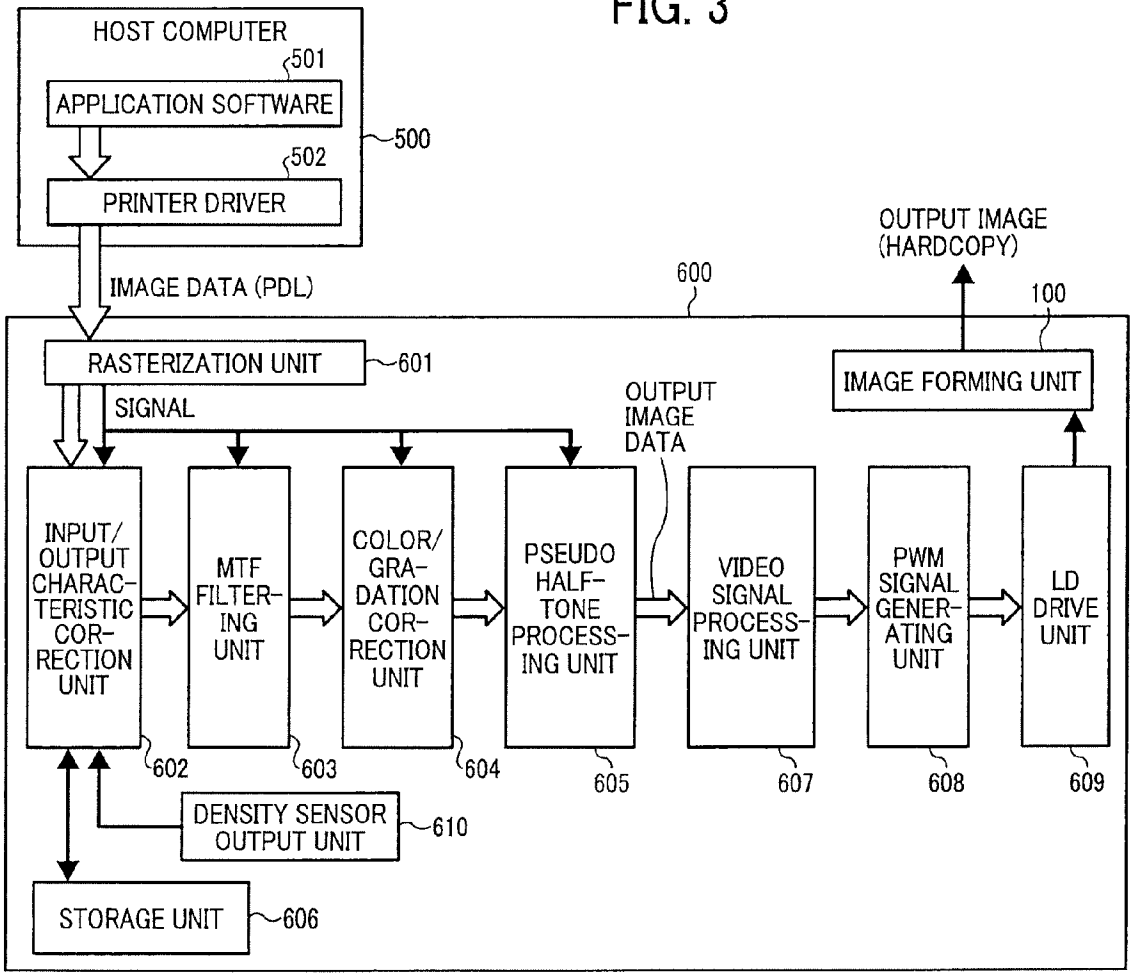
FIG. 3 is a block diagram illustrating image data processing performed by the image forming apparatus of FIG. 1.

Referring now to FIG. 3, a description is given of image data processing performed by the image forming apparatus 600 described above.

FIG. 3 is a block diagram illustrating the image data processing.

Firstly, image data is input to the image forming apparatus 600 from an external host computer 500, specifically from application software 501 via a printer driver 502 of the host computer 500. At this time, the image data is converted to page description language (PDL) by the printer driver 502. The image data described in the PDL is then input to a rasterization unit 601. When receiving the image data as input data, the rasterization unit 601 interprets the input data and forms a rasterized image from the input data. At this time, signals showing types and attributions of e.g., characters, lines, photographs, and graphic images are generated for each object. The signals are transmitted to, e.g., an input/output characteristic correction unit 602, a modulation transfer function filtering unit 603 (hereinafter simply referred to as MTF filtering unit 603), a color correction and gradation correction unit 604 (hereinafter simply referred to as color/gradation correction unit 604), and a pseudo halftone processing unit 605.

In the input/output characteristic correction unit 602, tones in the rasterized image are corrected so as to obtain desired characteristics according to an input/output characteristic correction signal. The input/output characteristic correction unit 602 uses an output of a density sensor output unit 610 while giving and receiving information to and from the storage unit 606 including both nonvolatile memory and volatile memory, thereby generating the input/output characteristic correction signal and performing correction. The input/output characteristic correction signal thus generated is stored in the nonvolatile memory of the storage unit 606 to be used for subsequent image formation. The MTF filtering unit 603 selects the optimum filter for each attribution according to the signal transmitted from the rasterization unit 601, thereby performing an enhancement process. It is to be noted that a typical MIF filtering process is herein employed, therefore a detailed description of the MTF filtering process is omitted. The image data is transmitted to the color/gradation correction unit 604 after the MTF filtering process is performed in the MTF filtering unit 603.

The color/gradation correction unit 604 performs various correction processes, such as a color correction process and a gradation correction process described below. The color/gradation correction unit 604 performs various correction processes, such as a color correction process and a gradation correction process described below. In the correction process, a red-green-blue (RGB) color space, that is, a PDL color space input from the host computer 500, is converted to a color space of the colors of toner used in the image forming unit 100, and more specifically, to a yellow-cyan-magenta-black (YCMK) color space. The color correction process is performed according to the signal showing attributions transmitted from the rasterization unit 601 by using an optimum color correction coefficient for each attribution. The gradation correction process is performed to correct the image data of the multi-tone image to be output, according to gradation characteristic data generated based on detected image densities of patches subject to detection of a gradation pattern image described later.

The image data is then transmitted from the color/gradation correction unit 604 to the pseudo halftone processing unit 605. The pseudo halftone processing unit 605 performs a pseudo halftone process to generate output image data. For example, the pseudo halftone process is performed on the data after the color/gradation correction process by dithering. In short, quantization is performed by comparison with a pre-stored dithering matrix.

The output image data is then transmitted from the pseudo halftone processing unit 605 to a video signal processing unit 607. The video signal processing unit 607 converts the output image data to a video signal. Then, the video signal is transmitted to a pulse width modulation signal generating unit 608 (hereinafter simply referred to as PWM signal generating unit 608). The PWM signal generating unit 608 generates a pulse width modulation (PWM) signal as a light source control signal according to the video signal. Then, the PWM signal is transmitted to a laser diode drive unit 609

(hereinafter simply referred to as LD drive unit 609). The LD drive unit 609 generates a laser diode (LD) drive signal according to the PWM signal. The laser diodes (LDs) as light sources incorporated in the optical writing unit 20 are driven according to the LD drive signal.

Figure 4:
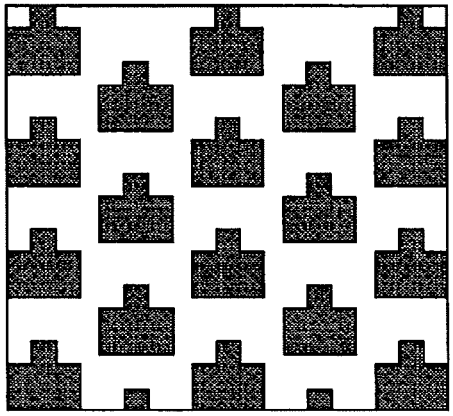
FIG. 4 is a plan view of a dot-like area coverage modulation pattern.
Figure 5:
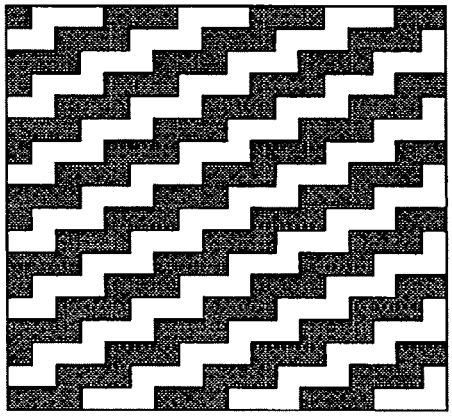
FIG. 5 is a plan view of a linear area coverage modulation pattern.

Referring now to FIGS. 4 and 5, a description is given of area coverage modulation patterns.

FIG. 4 is a plan view of a dot-like area coverage modulation pattern. FIG. 5 is a plan view of a linear area coverage modulation pattern.

In the image forming apparatus 600, area coverage modulation is performed according to such area coverage modulation patterns to reproduce a pseudo halftone. According to the signal showing attributions transmitted from the rasterization unit 601, a dithering matrix having the optimum number of lines and screen angle is selected for the optimum pseudo halftone process.

Figure 6:
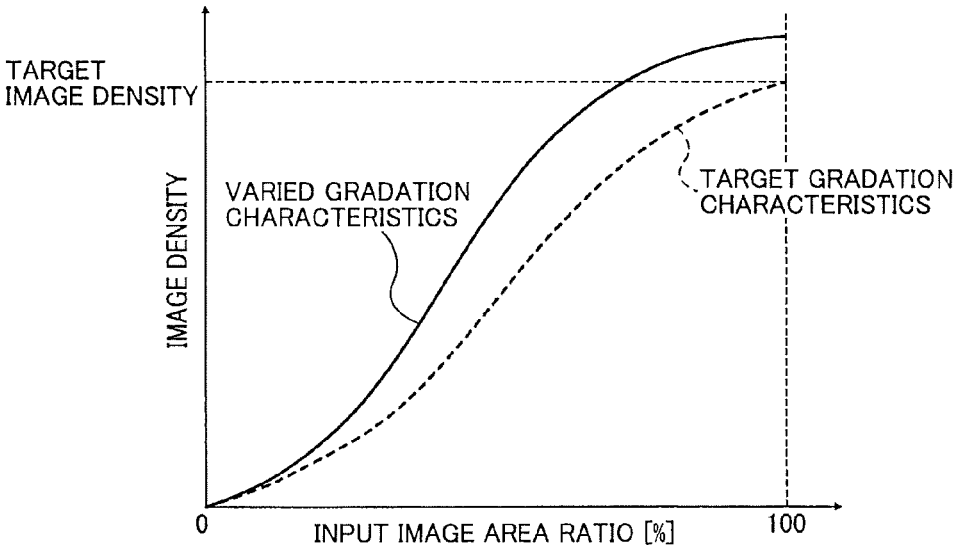
FIG. 6 is a graph of a relation between input image area ratio and image density on paper when gradation characteristics vary.

Referring now to FIG. 6, a description is given of a relation between input image area ratio and image density on paper when gradation characteristics vary.

FIG. 6 is a graph of the relation between input image area ratio and image density on paper when gradation characteristics vary.

As indicated by a solid line in FIG. 6, desired gradation characteristics may not be obtained with respect to an input image area ratio when, e.g., circumstances change, an image forming unit deteriorates, and/or toner density changes in a developing device in an image forming apparatus. Generally, when the toner density increases in the developing device, an increased amount of toner attaches to a latent image because the charge on the toner decreases. As a result, an overall image density on paper tends to increase. By contrast, when the toner density decreases in the developing device, a decreased amount of toner attaches to the latent image because the charge on the toner increases. As a result, the overall image density on paper tends to decrease. Such variations in gradation characteristics significantly affect colors made by combining two or three colors one atop another, and therefore to be corrected to target gradation characteristics.

Accordingly, the controller 15 forms a gradation pattern image serving as a shading pattern image of each color on the intermediate transfer belt 31. For each color, the image density is detected of a plurality of patches differing in gradation of the gradation pattern image. According to the detected image density, gradation characteristics data is established as illustrated in FIG. 6. The gradation characteristics data is corrected so as to obtain a target image density for each tone. Specifically, for each tone, the gradation characteristics data is corrected such that, with respect to the input image area ratio (%), an output image area ratio of an image to be actually output is related to a value that obtains a target image density.

The gradation pattern image is formed on the photoconductor 1 serving as a latent image bearer, and then transferred onto the intermediate transfer belt 31. The image density of the plurality of patches of the gradation pattern image is detected by a density sensor 37 serving as an image density sensor illustrated in FIGS. 1 and 2.

Referring now to FIGS. 7 through 10, a detailed description is given of the density sensor 37.

The density sensor 37 employs a line sensor typically mounted on, e.g., a document scanner, with a plurality of imaging elements.

Figure 7:
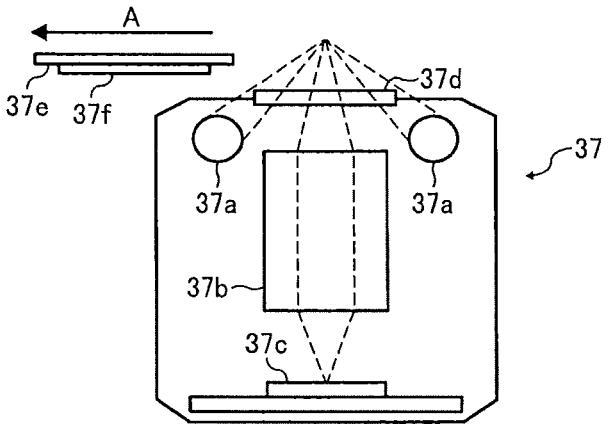
FIG. 7 is a schematic view of an image density sensor incorporated in the image forming apparatus of FIG. 1.

FIG. 7 is a schematic view of the density sensor 37.

The density sensor 37 includes, e.g., light sources 37*a*, a lens array 37*b*, an imaging element array 37*c*, a detection window 37*d* made of transparent glass, a shutter 37*e*, and a white reference board 37*f*.

The shutter 37*e* is movable back and forth, driven by an actuator, along the belt rotating direction indicated by arrow A in which the intermediate transfer belt 31 rotates to open and close the detection window 37*d*. In FIG. 7, the shutter 37*e* is moved from beneath the detection window 37*d*, to open the detection window 37*d*.

The white reference board 37*f* may be, e.g., a LUMIRROR® E20 (produced by Toray Industries, Inc.), which is a white film. The white reference board 37*f* is secured to a back surface of the shutter 37*e* by, e.g., a double-sided adhesive tape, thereby moving back and forth along the belt rotating direction with the shutter 37*e*.

Each of the light sources 37*a* may include a light guide having an end provided with a light emitting device. Alternatively, light-emitting diode (LED) arrays may be used as the light sources 37*a*. The light sources 37*a* emit white light. Alternatively, however, light sources that individually emit red light, green light and blue light may be used as the light sources 37*a*.

The lens array 37*b* includes, e.g., a SELFOC® lens. The imaging element array 37*c* includes an array of image sensors. The image sensors individually receive red light, green light and blue light focused by the lens array 37*b* and output signals corresponding to the red light, green light and blue light. For example, a complementary metal oxide semiconductor (CMOS) sensor or a charge-coupled device (CCD) sensor is used as the imaging element array 37*c*.

The density sensor 37 includes, e.g., a contact image sensor (CIS).

Figure 8:
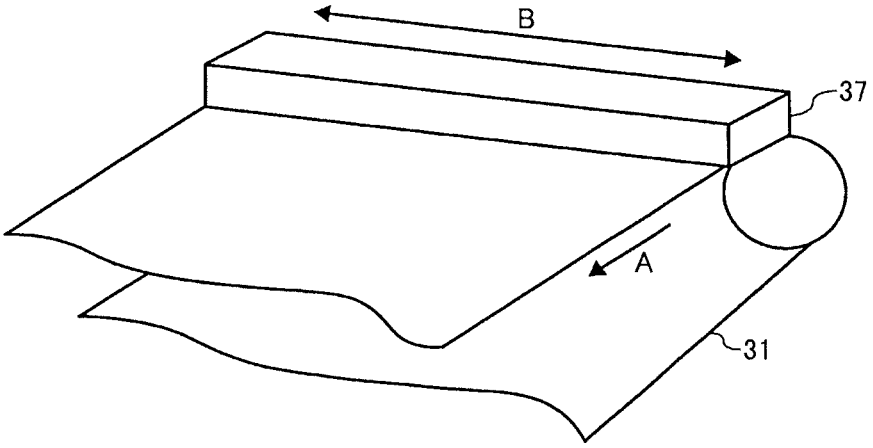
FIG. 8 is a perspective view from below of the image density sensor with a part of an intermediate transfer belt incorporated in the image forming apparatus of FIG. 1.

FIG. 8 is a perspective view from below of the density sensor 37 with a part of the intermediate transfer belt 31.

As illustrated in FIG. 8, the density sensor 37 is longer than a width of the intermediate transfer belt 31. With such a configuration, the density sensor 37 reads an entire area in a longitudinal direction of the gradation pattern image formed on the intermediate transfer belt 31. It is to be noted that, even if the density sensor 37 is not longer than the width of the intermediate transfer belt 31, the density sensor 37 reads the entire area of the gradation pattern image on the intermediate transfer belt 31 provided that the density sensor 37 is equal to or longer than a length of an effective image area in a width direction of the intermediate transfer belt 31 (hereinafter referred to as belt width direction) indicated by arrow B.

The longitudinal direction of the density sensor 37 is a direction in which the plurality of image sensors or imaging elements is arranged side by side. The density sensor 37 is disposed above the outer circumferential surface of the intermediate transfer belt 31 such that the density sensor 37 is shorter in the belt rotating direction indicated by arrow A than in the belt width direction, which is perpendicular to the belt rotating direction. In other words, the density sensor 37 is disposed such that the density sensor 37 is elongated in the belt width direction above the outer circumferential surface of the intermediate transfer belt 31.

Figure 9:
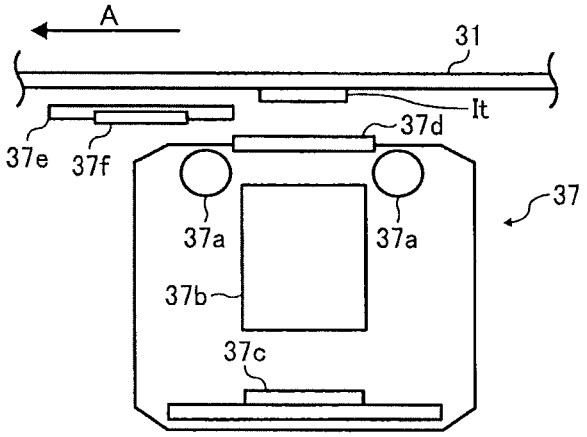
FIG. 9 is a schematic view of the image density sensor with a shutter thereof open.
Figure 10:
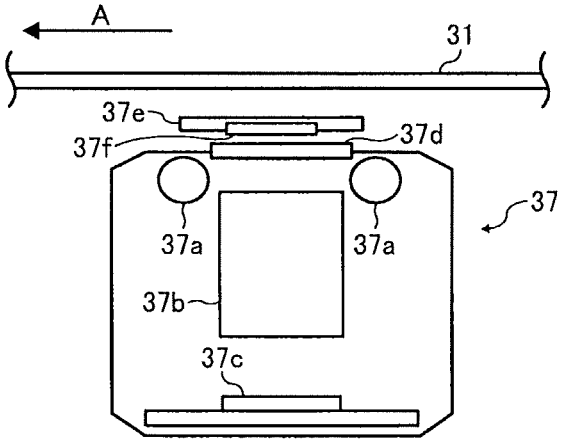
FIG. 10 is a schematic view of the image density sensor with the shutter thereof closed.

FIG. 9 is a schematic view of the density sensor 37 with the shutter 37*e* open. FIG. 10 is a schematic view of the density sensor 37 with the shutter 37*e* closed.

As illustrated in FIG. 9, the shutter 37*e* is open when the density sensor 37 reads a gradation pattern image It on the intermediate transfer belt 31 through the detection window 37*d*. By contrast, as illustrated in FIG. 10, the shutter 37*e* is moved to beneath the detection window 37*d* to close the detection window 37*d* under control of the controller 15 when the density sensor 37 does not read a toner image. Such a configuration prevents contamination of the detection window 37*d*. When the shutter 37*e* closes the detection window 37*d*, the density sensor 37 does not read the gradation pattern form It on the intermediate transfer belt 31, but instead reads the white reference board 37*f* secured to the back surface of the shutter 37*e*.

The controller 15 performs a correction process timed to correct gradation characteristics data. In the correction process, a gradation pattern image including a plurality of patches subject to detection is formed on the intermediate transfer belt 31, and then the image density of the plurality of patches is detected by the density sensor 37. According to the readings from the density sensor 37, gradation characteristics data of yellow, cyan, magenta and black colors are individually corrected to obtain a desired image density or pseudo halftone density for each tone.

At the initial operation after factory shipment, the controller 15 performs a shading correction data establishment process. In the shading correction data establishment process, shading correction data is established according to pixel data of image data obtained when the density sensor 37 reads the white reference board 37*f*. Specifically, if the white reference board 37*f* or the detection window 37*d* is perfectly clean, each pixel of the image data is white theoretically. For example, tones of red (R), green (G) and blue (B) of each pixel are expressed in natural number of eight bits with 201 tones from 0 to 200, handling tones from 200 to 255 as a tone 200. In this case, if the white reference board 37*f* and the detection window 37*d* are perfectly clean, each pixel of the image data obtained when the density sensor 37 reads the white reference board 37*f* has a value of R=200, G=200 and B=200. However, in actuality, the pixels of the image data slightly differ in value due to variation in sensitivity of imaging elements of an image line sensor or variation in amount of light emitted from light sources. Therefore, unevenness in density might be erroneously detected. In order to prevent such erroneous detection of unevenness in density, correction data for recognizing all the pixels as white is established as the shading correction data.

Referring now to FIGS. 11 through 14, a description is given of gradation pattern images formed on the intermediate transfer belt 31.

Figure 11:
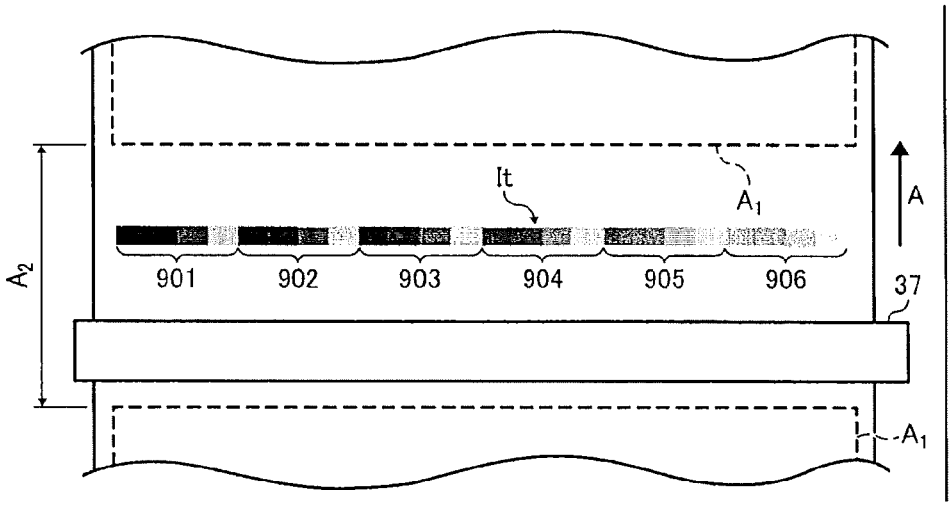
FIG. 11 is a bottom view of the intermediate transfer belt with the image density sensor.

FIG. 11 is a bottom view of the intermediate transfer belt 31 with the density sensor 37.

The controller 15 forms the gradation pattern image It on the outer circumferential surface of the intermediate transfer belt 31 such that the gradation pattern image It has a greater length in the belt width direction than a length in the belt rotating direction indicated by arrow A. In other words, as illustrated in FIG. 11, the gradation pattern image It is elongated in the belt width direction. It is not necessary to form the gradation pattern image It strictly along the belt width direction. For example, the gradation pattern image It may be slightly inclined from the belt width direction, provided that the gradation pattern image It is elongated relatively in the belt width direction.

In FIG. 11, a sheet corresponding area $A_1$ is a portion, of the entire area on the outer circumferential surface of the intermediate transfer belt 31, which contacts a recording medium at the secondary transfer nip. An image based on an order from a user is formed in the sheet corresponding area $A_1$. A sheet interval corresponding area $A_2$ is a portion, of the entire area in the circumferential direction of the intermediate transfer belt 31, between two successive sheet corresponding areas $A_1$. In the sheet interval corresponding area $A_2$, an image based on an order from a user is not formed. The controller 15 forms the gradation pattern image It in the sheet interval corresponding area $A_2$ as illustrated in FIG. 11.

The density sensor 37 is different from a simple reflective photosensor in that the density sensor 37 images the gradation pattern image It with a high resolution of from 300 to 1200 dots per inch (dpi). In other words, the resolution of the density sensor 37 in a main scanning direction perpendicular to the belt rotating direction is greater than number of tones. Unlike such a simple reflective photosensor that detects the image density of, e.g., a patch of several centimeter square, the density sensor 37 can detect the image density of a smaller patch, for example, a patch several millimeters square. Accordingly, in the present embodiment, the gradation pattern image It is downsized by including smaller patches than typical patches subject to detection. Additionally, the density sensor 37 can detect colors of the patches based on pixel values R, G and B of each pixel imaged.

As illustrated in FIG. 11, the gradation pattern image It includes patch groups 901 through 906 as first through sixth patch groups sequentially arranged side by side in the belt width direction.

Figure 12:
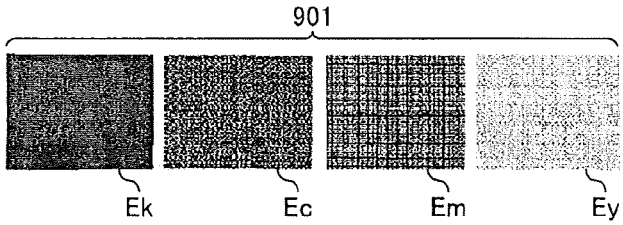
FIG. 12 is an enlarged plan view of a first patch group of a gradation pattern image.

FIG. 12 is an enlarged plan view of the patch group 901.

The patch group 901 includes four patches subject to detection, namely, a patch Ek formed with black toner, a patch Ec formed with cyan toner, a patch Em formed with magenta toner and a patch Ey formed with yellow toner. The patches Ek, Ec, Em and Ey are arranged in this order from left to right in FIG. 12 in the belt width direction. The patches Ek, Ec, Em and Ey are made by area coverage modulation such that the patches Ek, Ec, Em and Ey have identical tones with their primary colors. It is to be noted that the primary color is a color produced with a single color toner. In the image forming apparatus 600, black, cyan, magenta and yellow are primary colors. A secondary color is made by combining two different primary colors. A tertiary color is made by combining three different primary colors.

As illustrated in FIG. 11 and described above, the gradation pattern image It includes, the patch groups 902 through 906 other than the patch group 901. Similar to the patch group 901, each of the patch groups 902 through 906 includes four patches Ek, Ec, Em and Ey respectively formed with black, cyan, magenta and yellow toner. The patches Ek, Ec, Em and By of one patch group are made by area coverage modulation such that the patches Ek, Ec, Em and Ey have identical tones. The six patch groups 901 through 906 are arranged side by side such that the half tone densities of their patches decrease sequentially from left to right in FIG. 11. Preferably, six or more patch groups differing in gradation may be formed to obtain a gradation characteristics graph as illustrated in FIG. 6.

In addition, preferably, the patches Ek, Ec, Em and Ey may be formed at intervals as illustrated in FIG. 12. For example, patches Ek, Ec, Em and Ey may be formed having an interval larger than 120 μm in the belt width direction in an apparatus which may cause a misalignment between the patches Ek, Ec, Em and Ey of up to 120 μm. With such a configuration, even if the patches Ek, Ec, Em and Ey are misaligned at a maximum, the patches Ek, Ec, Em and By are still separated from each other. Thus, the patches Ek, Ec, Em and Ey are prevented from being superimposed one atop another, to further prevent an erroneous detection of the image densities of the patches Ek, Ec, Em and Ey.

Figure 13:
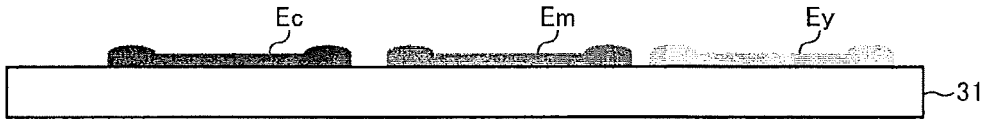
FIG. 13 is a cross-sectional view of patches under edge effects on the intermediate transfer belt.

FIG. 13 is a cross-sectional view of the patches Ec, Em and Ey under edge effects on the intermediate transfer belt 31.

In electrophotographic image forming apparatuses that form a toner image by means of electrical processes, like the image forming apparatus 600, an edge portion of an image has a higher image density than other portions of the image due to edge effects. Specifically, since electrical flux lines are concentrated toward edge portions of the image from the circumference of the image, a larger amount of toner attaches to the edge portions of the image or the patches Ec, Em and Ey in FIG. 13 than other portions of the image (hereinafter referred to as non-edge portions). In order to accurately detect the image densities of the patches Ek, Ec, Em and Ey, preferably, the image densities of the non-edge portions of the patches Ek, Ec, Em and Ey are detected. In other words, the patches Ek, Ec, Em and Ey have a sufficient size for including the non-edge portions. Accordingly, the controller 15 forms each of the patches Ek, Ec, Em and Ey having a larger size in a direction in which the patches Ek, Ec, Em and Ey are arranged side by side, or in the belt width direction, than twice the size of an edge-effect area from an edge of each of the patches Ek, Ec, Em and Ey. Specifically, in the image forming apparatus 600, the edge-effect area is an area of approximately 1.5 mm from an edge of an image toward the center of the image. Therefore, the patches Ek, Ec, Em and Ey have a size larger than 3 mm in the direction in which the patches Ek, Ec, Em and Ey are arranged side by side.

It is to be noted that the density sensor 37 as a line sensor is capable of detecting color and density per pixel. Therefore, from data of pixels obtained by imaging, data of pixels having a higher density than other pixels due to superimposed colors or edge effects are removed to extract data of pixels suitable for detection of image density so as to use the extracted data for calculation of the image density. Specifically, from the data of pixels, areas of yellow, cyan, magenta and black are specified based on original written pattern data. Then, the pixels corresponding to edges of an image are removed in terms of superimposed colors or edge effects to extract the other pixels.

In a timing process, the controller 15 obtains the time when the gradation pattern image It on the intermediate transfer belt 31 enters a position opposite the density sensor 37, based on the time of completing the optical writing of a latent image of the patch Ek on the sheet interval corresponding area $A_2$ on the photoconductor 1K. After the optical writing is finished, the latent image of the patch Ek is developed into a toner image, and then, the toner image is primarily transferred onto the intermediate transfer belt 31 at the area of contact where the photoconductor 1K and the intermediate transfer belt 31 meets. As the intermediate transfer belt 31 rotates, the toner image of the patch Ek enters the position opposite the density sensor 37, where the toner image meets the density sensor 37. The time from completion of the optical writing of the latent image to the time when the toner image enters the position opposite the density sensor 37 is ascertained in advance. When this time elapses, in other words, at a detection point entry time, the gradation pattern image It including the patch Ek enters the position opposite the density sensor 37. Slightly before the detection point entry time, the controller 15 opens the shutter 37*e* of the density sensor 37 so that the density sensor 37 starts imaging. The density sensor 37 continues imaging until the gradation pattern image It passes through the position where the density sensor 37 meets the gradation pattern image It. As described above, from data of pixels obtained by the imaging, data of pixels suitable for calculation of the image densities of the patches is extracted. Of the extracted data, data of a plurality of pixels extracted from one patch is averaged to obtain the image density of the patch. Thus, for each color of yellow, cyan, magenta and black, a graph of gradation characteristics data is established as illustrated in FIG. 6. Based on the results, an output image area is determined relative to an input image area so as to obtain a target pseudo halftone for each tone. Finally, based on the output image area, gradation characteristics data is established that converts the input image area to a predetermined output image area for each tone.

When finishing the imaging of the gradation pattern image It, the controller 15 turns off the light sources 37*a* of the density sensor 37, and then, closes the shutter 37*e*. It is to be noted that when gradation pattern images It are continuously formed in a plurality of sheet interval corresponding areas $A_2$, the shutter 37*e* may be kept open until all the gradation pattern images It are imaged.

In addition to the gradation pattern image It, the controller 15 forms a pattern image for detecting unevenness in density in the sheet interval corresponding area $A_2$ of the intermediate transfer belt 31.

Figure 14:
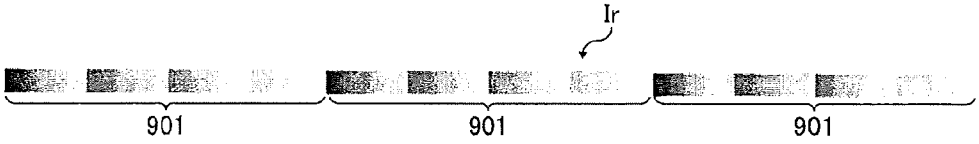
FIG. 14 is a plan view of a pattern image for detecting unevenness in density.

FIG. 14 is a plan view of a pattern image Ir for detecting unevenness in density.

The pattern image Ir is arranged, parallel to the gradation pattern image It, side by side in the belt rotating direction. For the sake of simplicity, the pattern image Ir includes only three patch groups 901 in FIG. 14. However, in actual, the pattern image Ir includes six patch groups 901 arranged side by side in the belt width direction.

In the six patch groups 901, patches of the same color are formed at identical tones and image densities. However, due to variation in sensitivity in a direction of rotational axis of the photoconductor 1, the patches may be formed slightly differing in image density. Therefore, the pattern image Ir is formed to detect such unevenness in image density in the belt width direction. The pattern image Ir enables finding of a patch having a higher or lower density than other patches although they have identical tones. Based on the results, the controller 15 may correct detected image densities of some of the plurality of patches included in the gradation pattern image It. Accordingly, the image density is accurately detected while minimizing decrease in detection accuracy due to unevenness in image density in the belt width direction.

In the present embodiment, the image forming apparatus 600 described above shortens the time for forming the gradation pattern image It compared to typical image forming apparatuses that forms a gradation pattern image as a shading pattern image on an intermediate transfer belt as an image bearer. Such a gradation pattern image includes a plurality of patches subject to detection arranged side by side in a belt rotating direction. The plurality of patches is written on the surface of a photoconductor under different optical intensities, and therefore differs in image density, i.e., the amount of toner attached per area. The image density of the plurality of patches is detected by a reflective photosensor disposed opposite an outer circumferential surface of the intermediate transfer belt. In such typical image forming apparatuses, it takes a relatively long time to form a gradation pattern image including a plurality of toner patches because a plurality of latent image patches are written on the surface of the photoconductor and sequentially reach a position opposite a developing device where the plurality of latent image patches are developed to toner patches that constitute the gradation pattern image. Then, the gradation pattern image including the plurality of patches is transferred to the intermediate transfer belt. It also takes a relatively long time to detect image density of the plurality of patches because the patches are sequentially reach a position opposite the reflective photosensor, as the intermediate transfer belt rotates, where the image densities of the patches are sequentially detected.

In other words, from the time of starting formation of the gradation pattern image It to the time of finishing the formation, the inter mediate transfer belt 31 is rotated at a distance equal to or longer than the length of the gradation pattern image It on the outer circumferential surface of the intermediate transfer belt 31 in the belt rotating direction. Additionally, in such typical image forming apparatuses, a gradation pattern image is longer in the belt rotating direction than in the belt width direction.

By contrast, in the image forming apparatus 600, the gradation pattern image It is longer in the belt width direction than in the belt rotating direction. Accordingly, to form the gradation pattern image It, the intermediate transfer belt 31 is rotated at a shorter distance than a distance at which an intermediate transfer belt incorporated in the typical image forming apparatuses is rotated to form the gradation pattern image having the same area as the gradation pattern image It.

Thus, the image forming apparatus 600 shortens the time for forming the gradation pattern image It compared to the typical image forming apparatuses.

Additionally, the image forming apparatus 600 shortens the time for detecting the image density of the gradation pattern image It compared to the typical image forming apparatuses. Specifically, from the time of starting detection of the gradation pattern image It to the time of finishing the detection, the intermediate transfer belt 31 is rotated at a distance equal to or longer than the length of the gradation pattern image It in the belt rotating direction. Because of the similar reason for shortening the time for forming the gradation pattern image It, the image forming apparatus 600 shortens the time for detecting the image density of the gradation pattern image It compared to the typical image forming apparatuses.

The following describes some variations of the pattern image It and the pattern image Ir that may be formed in the image forming apparatus 600 described above.

Figure 15:
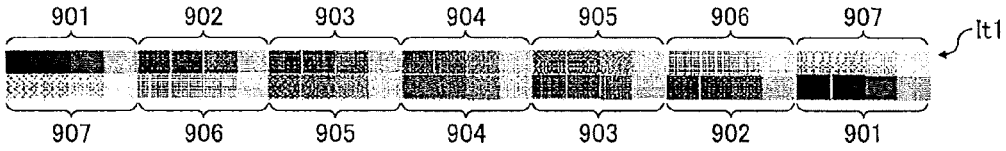
FIG. 15 is a plan view of a gradation pattern image according to a first variation.

Referring now to FIG. 15, a description is given of a first variation of the pattern images.

It is to be noted that, in the present example, the controller 15 does not form a pattern image Ir for detecting unevenness in density described above, but instead forms a gradation pattern image It1.

FIG. 15 is a plan view of the gradation pattern image It1.

The gradation pattern image It1 includes a first pattern portion and a second pattern portion arranged beside the first pattern portion in the belt rotating direction. The first pattern portion includes seven patch groups, namely, patch groups 901 through 907, so that the image densities of the patch groups 901 through 907 sequentially decreasing from one end to the other end, i.e., from left to right in FIG. 15, of the gradation pattern image It1 in the belt width direction. The second pattern portion includes seven patch groups, namely, patch groups 901 through 907, so that the image densities of the patch groups 901 through 907 sequentially increasing from one end to the other end, i.e., from left to right in FIG. 15, of the gradation pattern image It1 in the belt width direction. Each of the patch groups 901 through 907 includes patches subject to detection. In the first and second pattern portions, the patch groups 904 are formed in the center in the belt width direction on the intermediate transfer belt 31. With respect the other patch groups, namely, the patch groups 901, 902, 903, 905, 906 and 907, the patch groups having identical tones are formed at different positions in the belt width direction. For example, the patch group 901 of the first pattern portion is formed at one end portion of the gradation pattern image It1 whereas the patch group 901 of the second pattern portion is formed at the other end portion of the gradation pattern image It1.

For each color of yellow, cyan, magenta and black, the controller 15 averages detected image densities of the patches having identical tones between the first pattern portion and the second pattern portion. Accordingly, the image density is accurately detected while minimizing decrease in detection accuracy due to unevenness in image density in the belt width direction.

Figure 16:
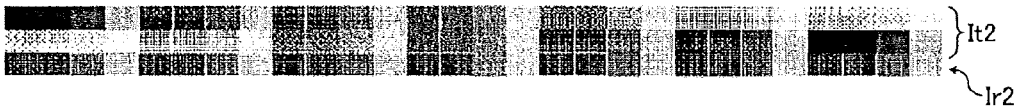
FIG. 16 is a plan view of a gradation pattern image and a pattern image for detecting unevenness in density according to a second variation.

Referring now to FIG. 16, a description is given of a second variation of the pattern images.

FIG. 16 is a plan view of a gradation pattern image It2 and a pattern image Ir2 for detecting unevenness in density.

The controller 15 forms the gradation pattern image 112 and the pattern image Ir2 side by side in the belt rotating direction in the sheet interval corresponding area $A_2$ of the intermediate transfer belt 31. The gradation pattern image It2 is the same as the gradation pattern image It1 of FIG. 15. The gradation pattern image It2 includes a first pattern portion and a second pattern portion arranged side by side in the belt rotating direction. The first pattern portion includes patch groups 901 through 907 so that the image densities of the patch groups 901 through 907 sequentially decreasing from left to right in FIG. 16. On the other hand, the second pattern portion includes patch groups 901 through 907 so that the image densities of the patch groups 901 through 907 sequentially increasing from left to right in FIG. 16. Each of the patch groups 901 through 907 includes patches subject to detection.

In the gradation pattern image It2, the patch groups 904 of both the first pattern portion and the second pattern portion are formed in the center in the belt width direction. Accordingly, even if detected image densities of the patches are averaged between the first pattern portion and the second pattern portion, detection accuracy of the image density might decrease due to unevenness in image density in the belt width direction with respect to the patch groups 904.

Hence, the controller 15 corrects the image density of the patch groups 904 based on unevenness in image density in the belt width direction detected by use of the pattern image Ir2, which is the same as the pattern image Ir described above. Accordingly, the image density of the patch groups 904 is accurately detected while minimizing decrease in detection accuracy due to unevenness in image density in the belt width direction.

Figure 17:
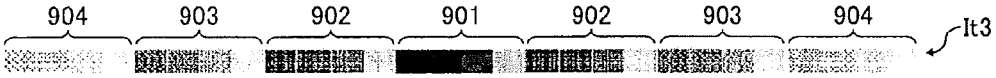
FIG. 17 is a plan view of a gradation pattern image according to a third variation.

Referring now to FIG. 17, a description is given of a third variation of pattern images.

FIG. 17 is a plan view of a gradation pattern image It3.

It is to be noted that the controller 15 does not form a pattern image Ir for detecting unevenness in density in the present variation.

The gradation pattern image It3 includes a patch group 901, a pair of patch groups 902, a pair of patch groups 903 and a pair of patch groups 904. Each of the patch groups 901 through 904 includes patches subject to detection. The patch group 901 is formed in the center in the belt width direction of the gradation pattern image It3.

On the left side of the patch group 901, the patch group 904, the patch group 903 and the patch group 902 are arranged in this order from left to right in FIG. 17. In other words, on the left side of the patch group 901 inclusive, the image density of the patch groups 901 through 904 gradually increases from left to right in FIG. 17.

By contrast, on the right side of the patch group 901, the patch group 902, the patch group 903 and the patch group 904 are arranged in this order from left to right in FIG. 17. In other words, on the right side of the patch group 901 inclusive, the image density of the patch groups 901 through 904 gradually decreases from left to right in FIG. 17.

For each of the pair of patch groups 902, the pair of patch groups 903 and the pair of patch groups 904, one of the patch group pairs is formed at a different position from the other of the patch group pairs in the belt width direction. The controller 15 averages detected image densities of the patches for each pair of patch groups. Accordingly, the image density is accurately detected while minimizing decrease in detection accuracy due to unevenness in image density in the belt width direction for each pair of patch groups.

Figure 18:
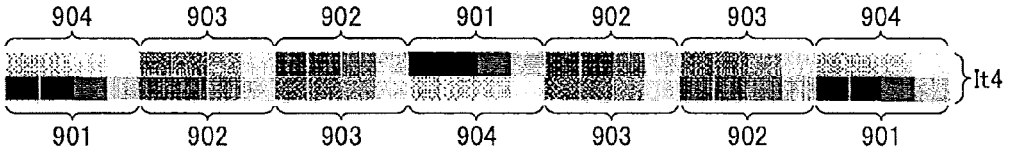
FIG. 18 is a plan view of a gradation pattern image according to a fourth variation.

Referring now to FIG. 18, a description is given of a fourth variation of pattern images.

FIG. 18 is a plan view of a gradation pattern image It4.

The gradation pattern image It3 includes a first pattern portion and a second pattern portion arranged beside the first pattern portion in the belt rotating direction. The first pattern portion includes a patch group 901, a pair of patch groups 902, a pair of patch groups 903 and a pair of patch groups 904. Whereas, the second pattern portion includes a pair of patch groups 901, a pair of patch groups 902, a pair of patch groups 903 and a patch group 904. Each of the patch groups 901 through 904 includes patches subject to detection. The first pattern portion, illustrated above the second pattern portion in FIG. 18, is the same as the gradation pattern image It3 of FIG. 17.

On the other hand, in the second pattern portion, the patch groups 901 through 904 are arranged in a manner opposite the patch groups 901 through 904 arranged in the first pattern portion. Specifically, the second pattern portion includes one patch group 904 having the lowest image density among the patch groups 901 through 904.

In the second pattern portion, the patch group 904 is formed in the center in the belt width direction on the intermediate transfer belt 31. On the left side of the patch group 904, the patch group 901, the patch group 902 and the patch group 903 are arranged in this order from left to right in FIG. 18. In other words, on the left side of the patch group 904 inclusive, the image density of the patch groups 901 through 904 gradually decreases from left to right in FIG. 18.

By contrast, on the right side of the patch group 904, the patch group 903, the patch group 902 and the patch group 901 are arranged in this order from left to right in FIG. 18. In other words, on the right side of the patch group 901 inclusive, the image density of the patch groups 901 through 904 gradually increases from left to right in FIG. 18.

For each pair or set of patch groups, the controller 15 averages detected image densities of the patches. Unlike the third variation, the controller 15 averages detected image densities of the patches of the three patch groups 901 formed at different positions in the belt width direction, in addition to the patch groups 902 through 904. Accordingly, without forming a pattern image for detecting unevenness in density, the image density of all the patch groups 901 through 904 is accurately detected while minimizing decrease in detection accuracy due to unevenness in image density in the belt width direction.

Figure 19:
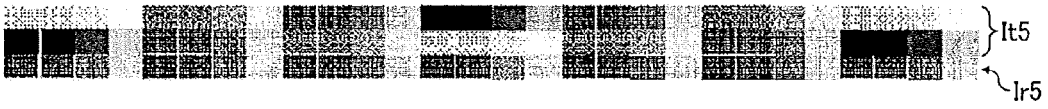
FIG. 19 is a plan view of a gradation pattern image and a pattern image for detecting unevenness in density according to a fifth variation.

Referring now to FIG. 19, a description is given of a fifth variation of pattern images.

FIG. 19 is a plan view of a gradation pattern image It5 and a pattern image Ir5 for detecting unevenness in density.

The controller 15 forms the gradation pattern image It5 and the pattern image Ir5 side by side in the belt rotating direction in the sheet interval corresponding area $A_2$ of the intermediate transfer belt 31. The gradation pattern image It5 is the same as the gradation pattern image It4 of FIG. 18. The gradation pattern image It5 includes a first pattern portion and a second pattern portion vertically illustrated in FIG. 19. The first pattern portion includes a patch group 901, a pair of patch groups 902, a pair of patch groups 903 and a pair of patch groups 904. Whereas, the second pattern portion includes a pair of patch groups 901, a pair of patch groups 902, a pair of patch groups 903 and a patch group 904. Each of the patch groups 901 through 904 includes patches subject to detection.

The controller 15 calculates the image density of the patches of each of the patch groups 901 through 904 of the gradation pattern image 115 in a similar manner as the fourth variation described above. Based on the detected image density of the pattern image Ir5, the controller 15 detects the unevenness in image density in the belt width direction. The controller 15 establishes a writing intensity change pattern for changing an optical writing intensity with respect to the photoconductor 1 in the main scanning direction, which is a direction of rotational axis of the photoconductor 1, so as to remove the unevenness in image density. A writing controller that controls the driving of the optical writing unit 20 changes the optical writing intensity in the main scanning direction according to the writing intensity change pattern established by the controller 15. Accordingly, unevenness in image density is minimized in the belt width direction.

As described above, in the image forming apparatus 600, a gradation pattern image It is formed, which includes a plurality of patches subject to detection differing in pseudo halftone density, to detect the image density of the plurality of patches. Based on the detected image density, gradation characteristics data is corrected. Alternatively, a shading pattern image may be formed, which includes a plurality of solid image patches subject to detection with an image area ratio of 100%, differing in density. According to detected image density of the plurality of solid image patches, image forming conditions may be corrected to obtain a desired solid image density. For example, a shading pattern image including a plurality of solid image patches is formed at different developing potentials. According to detected image density of the plurality of solid image patches, the developing potential for developing a solid image is corrected to obtain a desired solid image density. The patches are formed at different potentials by use of variation in optical writing intensity, instead of different developing biases, as the patches are arranged side by side in the main scanning direction.

In the variations described above, the pattern images are formed including different color patches arranged side by side in the belt width direction. Alternatively, however, a pattern image may be formed including identical color patches arranged side by side in the belt width direction and different color patches arranged side by side in the belt rotating direction. The following describes some variations of pattern images for enhancing detection accuracy. Specifically, a plurality of multiple-tone images are arranged side by side in the belt width direction for accurate detection of image density.

Figure 20:
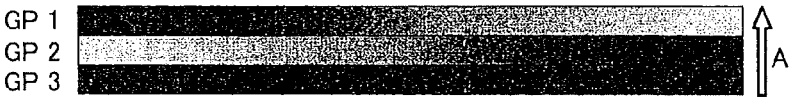
FIG. 20 is a plan view of three gradation pattern images according to a sixth variation.
Figure 21:
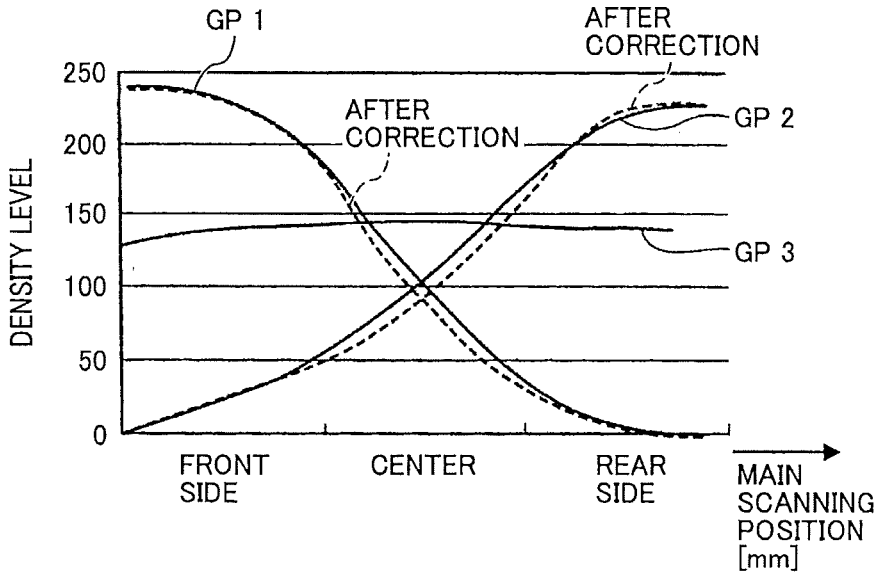
FIG. 21 is a graph of a relation between the density of gradation pattern images and the position in a main scanning direction.
Figure 22:
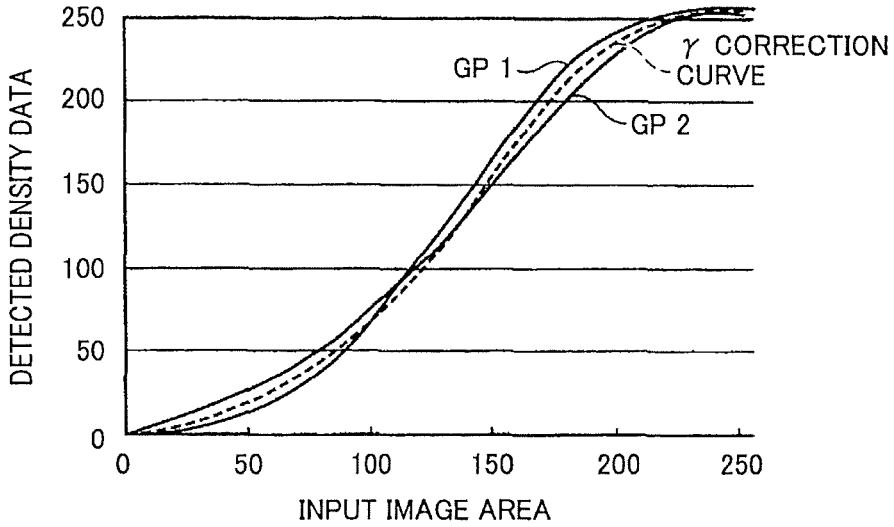
FIG. 22 is a graph of an example of non-linear function as an approximate function of gradation characteristics with which the first through third gradation pattern images are determined by use of the detected image density of FIG. 21.

Referring now to FIGS. 20 through 22, a description is given of a sixth variation of pattern images.

FIG. 20 is a plan view of a gradation pattern image GP1, a gradation pattern image GP2 and a uniform pattern image GP3 according to the sixth variation.

The gradation pattern image GP1 is a first gradation pattern image changing in darkness in the main scanning direction perpendicular to the belt rotating direction indicated by arrow A. The gradation pattern image GP2 is a second gradation pattern image changing in darkness in a direction opposite the direction in which the darkness of the gradation pattern image GP1 changes.

The uniform pattern image GP3 is a third gradation pattern image having an even darkness in the main scanning direction.

Each of the first through third gradation pattern images includes an imaged portion having 256 tones in total from a minimum tone 0 to a maximum tone 255, which corresponds to a gradation range of a multi-tone image that can be formed by the image forming apparatus 600 described above.

The first through third gradation pattern images are formed to obtain data for creating or correcting a gamma (γ) correction table.

Each of the first gradation pattern image and the second gradation pattern image includes a plurality of monospaced patterns arranged without intervals in the main scanning direction. The first through third gradation pattern images are disposed at identical positions in the main scanning direction on the one hand, at different positions so as to be adjacent to each other in the belt rotating direction on the other hand.

In the first through third gradation pattern images, tones gradually change from one to another without intervals in the main scanning direction. Alternatively, however, the first through third gradation pattern images may be formed as intermittent gradation pattern images in which tones of from 0 to 255 are extracted at approximately even intervals.

For the sake of simplicity, the first through third gradation pattern images are edged with solid lines.

FIG. 21 is a graph of a relation between the density of gradation pattern images and the position in the main scanning direction.

In FIG. 21, the solid lines indicate symmetrical profiles between the gradation pattern images GP1 and GP2 with respect to the position in the main scanning direction, although the profiles are not strictly symmetrical due to individual variability of density sensors and unevenness in density in the main scanning direction.

The broken lines indicate density data of the gradation pattern images GP1 and GP2 corrected according to density data of the uniform pattern image GP3. In the present variation, the uniform pattern image GP3 is formed according to image data of an area coverage modulation of approximately 75%, because dots are usually influenced by the imaging units of image forming apparatuses in an area coverage modulation of approximately 75%.

However, the area coverage modulation is not limited at approximately 75%, provided that a profile representing unevenness in density in the main scanning direction is obtained. The unevenness in density of the uniform pattern image GP3 is expressed by a ratio at a predetermined position in the main scanning direction to an average density.

FIG. 22 is a graph of an example of non-linear function as an approximate function of gradation characteristics with which the first through third gradation pattern images are determined by use of the detected image density of FIG. 21.

In FIG. 22, the broken line indicates an approximate curve obtained by mean values between the gradation pattern images GP1 and GP2. The approximate curve is used to create or correct the gamma correction table.

FIG. 22 illustrates a non-linear function as an approximate function determined by applying quintic approximation to the detected image density of FIG. 21.

According to the non-linear function as an approximate function, the gradation characteristic data is obtained that indicates the relation between image density levels and entire tones of from 0 to 255 in the gradation range used for correcting the gradation upon multi-tone image formation.

Gradation correction operation after obtaining the gradation characteristics data includes, e.g., a gradation correction or gamma correction process, upon multi-tone image formation, on the data of an image to be output by use of the gradation characteristic data to obtain a target image density, that is, target gradation characteristics, for each tone. The gradation correction process is performed by the controller 15 serving as an area coverage modulation corrector.

In FIG. 22, the tone is 0 at the Y-intercept, which is a tone of a background area without toner attached. An accurate output level of the density sensor 37 relative to the background area is obtained by detecting an area without toner.

Specifically, an exposed surface of the intermediate transfer belt 31 is detected by the density sensor 37 in advance. By fixing the detected value to the y-intercept and applying the least-squares approach, approximation can be executed with higher accuracy. Accordingly, an accurate approximate function or non-linear function can be achieved.

As described above, in the present variation, the gamma correction table is created according to the detected image density of the first through third gradation pattern images. Accordingly, both the influences of unevenness in density in the main scanning direction and variation in detection of density sensors are removed with respect to the values calculated for creating the gamma correction table, to correctly reproduce desired density and gradation.

Specifically, in the first and second gradation pattern images, the darkness gradually changes in opposite directions. The density data is corrected by use of the density data of the third gradation pattern image having an even density. Accordingly, both the influences of unevenness in density in the main scanning direction and variation in detection of density sensors are accurately removed.

Figure 23:
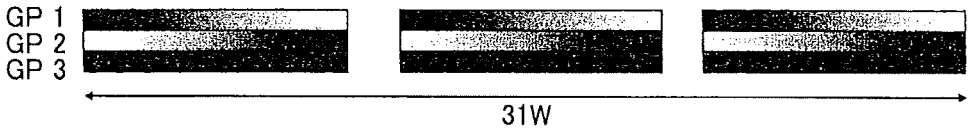
FIG. 23 is a plan view of sets of first through third gradation pattern images according to a seventh variation.

Referring now to FIG. 23, a description is given of a seventh variation of pattern images.

FIG. 23 is a plan view of sets of a gradation pattern image GP1, a gradation pattern image GP2 and a uniform pattern image GP3 serving as first, second and third gradation pattern images, respectively according to the seventh variation.

Unlike the sixth variation in which each of the first through third gradation pattern images has a continuous length in the main scanning direction, sets of the first through third gradation pattern images are formed at intervals in the main scanning direction within an image forming width 31W of the intermediate transfer belt 31. A gamma correction table is created based on a mean value of detected densities of the sets of the first through third gradation pattern images.

Since the correction table does not depend on density characteristics at a certain position in the main scanning direction, desired density and gradation are correctly reproduced without being affected by individual variability of the apparatus.

Figure 24:
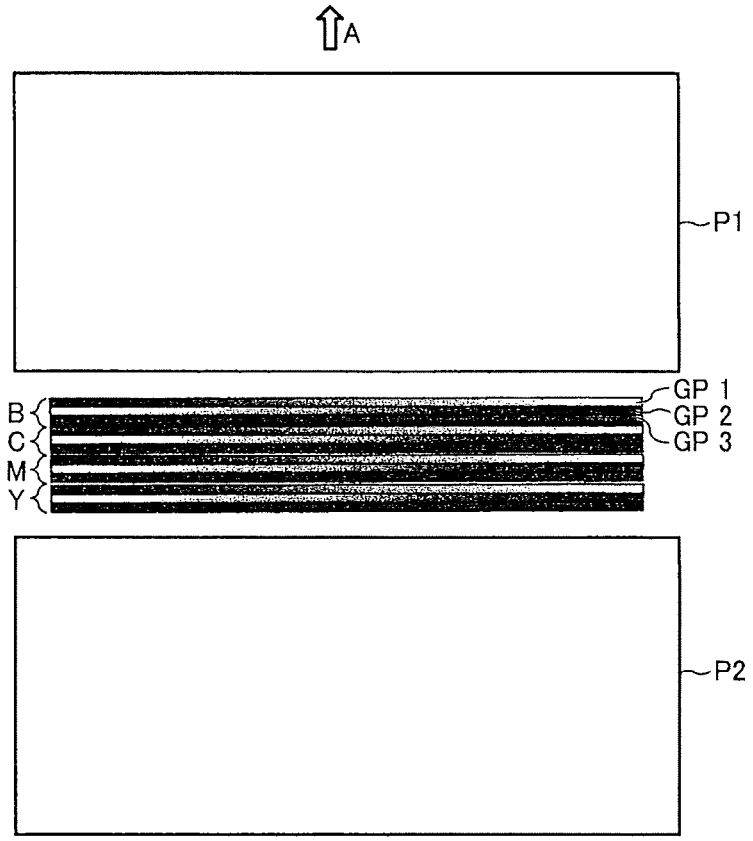
FIG. 24 is a plan view of sets of first through third gradation pattern images for four colors between recording media according to an eighth variation.

Referring now to FIG. 24, a description is given of an eighth variation of pattern images.

FIG. 24 is a plan view of sets of a gradation pattern image GP1, a gradation pattern image GP2 and a uniform pattern image GP3 between recording media P1 and P2 according to the eighth variation.

Like the sixth and the seventh variations described above, the gradation pattern images GP1 and GP2 and the uniform pattern image GP3 serve as first, second and third gradation pattern images, respectively. Since all the sets of first through third gradation pattern images have identical configurations, differing only in the color of toner, reference numerals GP1, GP2 and GP3 are assigned only to the set of first through third gradation pattern images for black color, for the sake of simplicity.

In the present variation, a set of first through third gradation pattern images is formed for each of black (B), cyan (C), magenta (M) and yellow (Y), outside continuous imaging areas.

Specifically, the four sets of first through third gradation pattern images are formed between the recording medium P1 and the recording medium P2, which follows the recording medium P1 in the belt rotating direction indicated by arrow A during continuous printing. Accordingly, images having appropriate density and gradation are provided without reducing printing speed.

In the present variation, all the four sets of first through third gradation pattern images are formed within an area or interval. Alternatively, however, the sets of first through third gradation pattern images may be formed in different areas or intervals if the interval between the recording media is too small to include all the four sets of first through third pattern images, or if there is a plurality of modes such as a text mode and a photographic mode.

Figure 25:
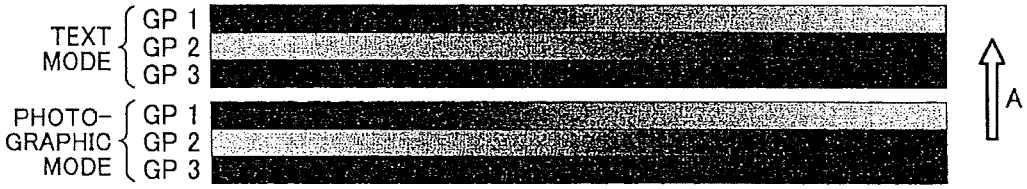
FIG. 25 is a plan view of sets of first through third gradation pattern images for text and photographic modes according to a ninth variation.

Referring now to FIG. 25, a description is given of a ninth variation of pattern images.

FIG. 25 is a plan view of sets of a gradation pattern image GP1, a gradation pattern image GP2 and a uniform pattern image GP3 for text and photographic modes to create a gamma correction table for each of the text and photographic modes.

Like the sixth through eighth variations described above, the gradation pattern images GP1 and GP2 and the uniform pattern image GP3 serve as first, second and third gradation pattern images, respectively.

In the present variation, two sets of first through third gradation pattern images are formed for the text and photographic modes, as different gradation patterns, namely, a gradation pattern for correcting text images and a gradation pattern for correcting photographic images, respectively. The two sets of first through third gradation pattern images are disposed at identical positions in the main scanning direction on the one hand, different positions in the belt rotating direction indicated by arrow A on the other hand.

The gamma correction table for text images is created based on detected image density of the set of first through third gradation pattern images for the text mode. Whereas, the gamma correction table for photographic images is created based on detected image density of the set of first through third gradation pattern images for the photographic mode. Accordingly, images having appropriate density and gradation are provided regardless of printing mode.

Figure 26:
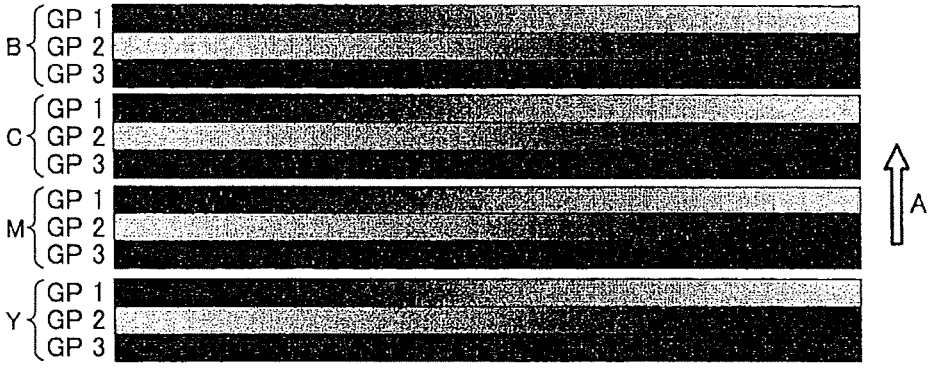
FIG. 26 is a plan view of sets of first through third gradation pattern images for four colors according to a tenth variation.

Referring now to FIG. 26, a description is given of a tenth variation of pattern images.

FIG. 26 is a plan view of sets of a gradation pattern image GP1, a gradation pattern image GP2 and a uniform pattern image GP3 for four colors of black (B), cyan (C), magenta (M) and yellow (Y), to create a gamma correction table for each of the four colors.

Like the sixth through ninth variations described above, the gradation pattern images GP1 and GP2 and the uniform pattern image GP3 serve as first, second and third gradation pattern images, respectively.

Specifically, the four sets of first through third gradation pattern images are separately formed for black (B), cyan (C), magenta (M) and yellow (Y), respectively, at different positions in the belt rotating direction indicated by arrow A. The density sensor 37 is disposed to detect the density of each of the four sets of first through third gradation pattern images. With such a configuration, color reproducibility is enhanced in addition to the stability of density and gradation, particularly in color image forming apparatuses.

To obtain data for the text and photographic modes for each of the four colors, eight (4×2) sets of first through third gradation pattern images may be formed.

In the variations described above, the density sensor 37 detects the gradation pattern images formed on the intermediate transfer belt 31. Alternatively, in addition to the density sensor 37, another density sensor may be provided to detect first through third gradation pattern images transferred onto a recording medium. A gamma correction table may be created based on readings from either or both of the image density sensors to accurately correct area coverage modulation regardless of kinds of recording media. Accordingly, the gradation is kept stable despite, e.g., changes in temperature or humidity, or degradation of parts over time.

In such a case, images having appropriate density and gradation may be obtained while minimizing output of recording media provided that the frequency of forming the gradation pattern images on an image bearer (e.g., intermediate transfer belt) is greater than the frequency of forming the gradation pattern images on recording media.

Although specific embodiments and variations are described, e.g., the embodiments and variations according to the present disclosure are not limited to those specifically described herein. Several aspects of the image forming apparatus are exemplified as follows.

Aspect 1.

An image forming apparatus (e.g., image forming apparatus 600) includes an image bearer (e.g., intermediate transfer belt 31), an image forming device (e.g., a combination of imaging units 10 and a transfer unit 30), a transfer device (e.g., secondary transfer nip and a secondary-transfer backup roller 35 of the transfer unit the image forming device), a line sensor as an image density sensor (e.g., density sensor 37) and a controller (e.g., controller 15). The image forming device forms a toner image on the image bearer. The transfer device transfers the toner image from the image bearer to a recording medium. The image density sensor detects image density of the toner image on the image bearer. The image density sensor is a line sensor disposed so as to be shorter in a rotational direction of the image bearer (e.g., belt rotating direction) than in a width direction of the image bearer (e.g., belt width direction) perpendicular to the rotational direction of the image bearer. The controller is operatively connected to the image density sensor. The controller forms a shading pattern image (e.g., gradation pattern image It) including a plurality of patches subject to detection (e.g., patches Ek, Ec, Em and Ey) on an outer circumferential surface of the image bearer with the image forming device. The shading pattern image is shorter in the rotational direction of the image bearer than in the width direction of the image bearer. The controller also detects image density of the plurality of patches of the shading pattern image with the image density sensor, so as to control image density.

With such a configuration, the image forming apparatus shortens the time for forming the shading pattern image compared to typical image forming apparatuses. Specifically, from the time of starting formation of the shading pattern image to the time of finishing the formation, the image bearer is rotated at a distance equal to or longer than the length of the gradation pattern image It on the outer circumferential surface of the intermediate transfer belt 31 in the rotational direction of the image bearer. In the typical image forming apparatuses, a shading pattern image is longer in the belt rotating direction than in the width direction of the image bearer. By contrast, in Aspect 1, the shading pattern image is longer in the width direction of the image bearer than in the rotational direction of the image bearer, thereby shortening the rotational distance of the image bearer to form the shading pattern image compared to the typical image forming apparatuses. Thus, the image forming apparatus shortens the time for forming the shading pattern image compared to the typical image forming apparatuses.

Additionally, in Aspect 1, the image forming apparatus shortens the time for detecting the image density of the shading pattern image compared to the typical image forming apparatuses. Specifically, from the time of starting detection of the shading pattern image to the time of finishing the detection, the image bearer is rotated at a distance equal to or longer than the length of the gradation pattern image It in the rotational direction of the image bearer. Thus, because of the similar reason for shortening the time for forming the shading pattern image, the image forming apparatus shortens the time for detecting the image density of the shading pattern image compared to the typical image forming apparatuses.

As described above, the image forming apparatus shortens both the time for forming the shading pattern image and the time for detecting the image density of the shading pattern image compared to the typical image forming apparatuses.

Aspect 2.

In the image forming apparatus according to Aspect 1, the controller forms, as the shading pattern image, a plurality of patches subject to detection differing in image density and arranged side by side in a longitudinal direction of the shading pattern image at predetermined intervals.

With such a configuration, the image density is accurately detected as the adjacent patches of the plurality of patches are aligned without overlapping each other.

Aspect 3.

In the image forming apparatus according to Aspect 2, the controller forms, as each of the plurality of patches, a patch subject to detection having a larger size in a direction in which the plurality of patches is arranged side by side, than twice a size of an edge-effect area from an edge of the patch.

With such a configuration, each of the plurality of patches includes a portion appropriate for detection of image density inside an edge portion where the image density is greater than other portions due to edge effects.

Aspect 4.

In the image forming apparatus according to any one of Aspect 1 through Aspect 3, the controller forms, as the shading pattern image including a plurality of patches subject to detection differing in image density, a plurality of patches subject to detection differing in image density and arranged side by side in a longitudinal direction of the shading pattern image, while forming a plurality of patches subject to detection for each of different image densities of the plurality of patches.

With such a configuration, the image density is accurately detected by averaging detected image density of the plurality of patches and the plurality of patches for each image density.

Aspect 5.

In the image forming apparatus according to Aspect 4, at least three patches having identical image densities of the shading pattern image are disposed on one end portion, a center portion and the other end portion of the shading pattern image in the width direction of the image bearer, as illustrated in FIG. 18.

With such a configuration, detected image density of the at least three patches disposed on the one end portion, the center portion and the other end portion of the shading pattern image are averaged to accurately detect the image density of the patches, preventing decrease in detection accuracy due to unevenness in image density in the width direction of the image bearer.

Aspect 6.

In the image forming apparatus according to any one of Aspect 1 through Aspect 3, the image forming device forms a plurality of images differing in primary color (e.g., yellow, cyan, magenta and black). The controller forms, as the shading pattern image, a plurality of patch groups (e.g., patch groups 901 through 907). Each group of the plurality of patch groups includes a plurality of patches subject to detection formed with the image forming device. The plurality of patches differs in primary color at a predetermined image density.

With such a configuration, the image density is accurately detected by averaging detected image density of the plurality of patch groups for each of the primary colors.

Aspect 7.

In the image forming apparatus according to Aspect 6, the controller forms, as the shading pattern image, a plurality of patch groups as a first plurality of patch groups differing in image density and arranged side by side so that image density of the plurality of patch groups increases or decreases from one end to the other end of the shading pattern image in the width direction of the image bearer. Each group of the plurality of patch groups includes a plurality of patches as a first plurality of patches subject to detection formed with the image forming device. The plurality of patches differs in primary color at a predetermined image density.

In such a configuration, for each of the plurality of primary colors, the image density of the plurality of patch groups gradually increases or decreases from one end to the other end of the shading pattern image in the width direction of the image bearer. Accordingly, unexpected abnormality in image density is detected in which the image density does not gradually increase or decrease.

Aspect 8.

In the image forming apparatus according to Aspect 7, the controller further forms another plurality of patch groups as a second plurality of patch groups arranged beside the first plurality of patch groups in the rotational direction of the image bearer. Each group of the second plurality of patch groups includes another plurality of patches as a second plurality of patches same as the first plurality of patches. The second plurality of patch groups differs in image density and is arranged side by side so that image density of the second plurality of patch groups increases or decreases in a way opposite the image density of the first plurality of patch groups from the one end to the other end of the shading pattern image in the width direction of the image bearer.

In such a configuration, for each of the plurality of primary colors, detected image densities of the patches at a predetermined density are averaged to prevent detection errors due to variation in image density in the width direction of the image bearer perpendicular to the rotational direction of the image bearer.

Aspect 9.

In the image forming apparatus according to Aspect 6, the controller forms, as the shading pattern image, a plurality of patch groups as a first plurality of patch groups differing in image density and arranged side by side so that image density of the plurality of patch groups increases or decreases from opposed ends to a center of the shading pattern image in the width direction of the image bearer.

In such a configuration, for each of the plurality of primary colors, detected image densities of the patches at a predetermined density are averaged to prevent detection errors due to variation in image density in the width direction of the image bearer perpendicular to the rotational direction of the image bearer. Each group of the plurality of patch groups includes a plurality of patches as a first plurality of patches subject to detection formed with the image forming device. The plurality of patches differs in primary color at a predetermined image density.

Aspect 10.

In the image forming apparatus according to Aspect 9, the controller further forms another plurality of patch groups as a second plurality of patch groups arranged beside the first plurality of patch groups in the rotational direction of the image bearer. Each group of the second plurality of patch groups includes another plurality of patches as a second plurality of patches same as the first plurality of patches. The second plurality of patch groups differs in image density and is arranged side by side so that image density of the second plurality of patch groups increases or decreases in a way opposite the image density of the first plurality of patch groups from the opposed ends to the center of the shading pattern image in the width direction of the image bearer.

Such a configuration enhances prevention of detection errors due to variation in image density in the width direction of the image bearer.

This disclosure has been described above with reference to specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different embodiments may be combined with each other and/or substituted for each other within the scope of this invention. The number of constituent elements and their locations, shapes, and so forth are not limited to any of the structure for performing the methodology illustrated in the drawings.

What is claimed is:

1. An image forming apparatus comprising:

an image bearer;

an image forming device to form a toner image on the image bearer;

a transfer device to transfer the toner image from the image bearer to a recording medium;

a line sensor as an image density sensor to detect image density of the toner image on the image bearer, the image density sensor being disposed so as to be shorter in a rotational direction of the image bearer than in a width direction of the image bearer perpendicular to the rotational direction of the image bearer; and a controller operatively connected to the image density sensor, to form a shading pattern image including a plurality of patches subject to detection on an outer circumferential surface of the image bearer with the image forming device, the shading pattern image being shorter in the rotational direction of the image bearer than in the width direction of the image bearer, and to detect image density of the plurality of patches of the shading pattern image with the image density sensor, so as to control image density.

2. The image forming apparatus according to claim 1, wherein the controller forms, as the shading pattern image, a plurality of patches subject to detection differing in image density and arranged side by side in a longitudinal direction of the shading pattern image at predetermined intervals.

3. The image forming apparatus according to claim 2, wherein the controller forms, as each of the plurality of patches, a patch subject to detection having a larger size in a direction in which the plurality of patches is arranged side by side, than twice a size of an edge-effect area from an edge of the patch.

4. The image forming apparatus according to claim 1, wherein the controller forms, as the shading pattern image including a plurality of patches subject to detection differing in image density, a plurality of patches subject to detection differing in image density and arranged side by side in a longitudinal direction of the shading pattern image, while forming a plurality of patches subject to detection for each of different image densities of the plurality of patches.

5. The image forming apparatus according to claim 4, wherein at least three patches having identical image densities of the shading pattern image are disposed on one end portion, a center portion and the other end portion of the shading pattern image in the width direction of the image bearer.

6. The image forming apparatus according to claim 1, wherein the image forming device forms a plurality of images differing in primary color, wherein the controller forms, as the shading pattern image, a plurality of patch groups, wherein each group of the plurality of patch groups includes a plurality of patches subject to detection formed with the image forming device, and wherein the plurality of patches differs in primary color at a predetermined image density.

7. The image forming apparatus according to claim 6, wherein the controller forms, as the shading pattern image, a plurality of patch groups differing in image density and arranged side by side so that image density of the plurality of patch groups increases or decreases from one end to the other end of the shading pattern image in the width direction of the image bearer, wherein each group of the plurality of patch groups includes a plurality of patches subject to detection formed with the image forming device, and wherein the plurality of patches differs in primary color at a predetermined image density.

8. The image forming apparatus according to claim 7, wherein the controller further forms another plurality of patch groups arranged beside the plurality of patch groups in the rotational direction of the image bearer, wherein each group of said another plurality of patch groups includes another plurality of patches same as the plurality of patches, and wherein said another plurality of patch groups differs in image density and is arranged side by side so that image density of said another plurality of patch groups increases or decreases in a way opposite the image density of the plurality of patch groups from the one end to the other end of the shading pattern image in the width direction of the image bearer.

9. The image forming apparatus according to claim 6, wherein the controller forms, as the shading pattern image, a plurality of patch groups differing in image density and arranged side by side so that image density of the plurality of patch groups increases or decreases from opposed ends to a center of the shading pattern image in the width direction of the image bearer, wherein each group of the plurality of patch groups includes a plurality of patches subject to detection formed with the image forming device, and wherein the plurality of patches differs in primary color at a predetermined image density.

10. The image forming apparatus according to claim 9, wherein the controller further forms another plurality of patch groups arranged beside the plurality of patch groups in the rotational direction of the image bearer, wherein each group of said another plurality of patch groups includes another plurality of patches same as the plurality of patches, and wherein said another plurality of patch groups differs in image density and is arranged side by side so that image density of said another plurality of patch groups increases or decreases in a way opposite the image density of the plurality of patch groups from the opposed ends to the center of the shading pattern image in the width direction of the image bearer.

11. The image forming apparatus according to claim 1, wherein the controller forms, as the shading pattern image, a first set of gradation pattern images including:

a first gradation pattern image having tones changing in a first direction;

a second gradation pattern image having tones changing in a second direction opposite the first direction; and a third gradation pattern image having identical tones in a main scanning direction perpendicular to the rotational direction of the image bearer.

12. The image forming apparatus according to claim 11, wherein the controller further forms a second set of gradation pattern images disposed at a position identical to the first set of gradation pattern images in the main scanning direction and different from the first set of gradation pattern images in the rotational direction of the image bearer, wherein the first set of gradation pattern images and the second set of gradation pattern images differ in gradation pattern to correct photographic images and text images, respectively, wherein the image density sensor detects image densities of the first set of gradation pattern images and the second set of gradation pattern images, and wherein the controller creates a gamma correction table for photographic images and a gamma correction table for text images according to the image densities of the first set of gradation pattern images and the second set of gradation pattern images, respectively, detected by the image density sensor.

13. The image forming apparatus according to claim 11, wherein the controller further forms a second set of gradation pattern images for cyan, a third set of gradation pattern images for magenta, and a fourth set of gradation pattern images for yellow, at different positions from the first set of gradation pattern images for black in the rotational direction of the image bearer, and wherein the image density sensor separately detects image densities of the first set of gradation pattern images for black, the second set of gradation pattern images for cyan, the third set of gradation pattern images for magenta, and the fourth set of gradation pattern images for yellow.

14. The image forming apparatus according to claim 11, wherein resolution of the image density sensor in the main scanning direction is greater than number of tones.

15. The image forming apparatus according to claim 11, further comprising another image density sensor, wherein the transfer device transfers the shading pattern image on a recording medium from the image bearer, wherein said another image density sensor detects the shading pattern image on the recording medium, and wherein the controller creates a gamma correction table according to readings from one of the image density sensor and said another image density sensor.

16. The image forming apparatus according to claim 15, wherein a frequency of forming the shading pattern image on the image bearer is greater than a frequency of forming the shading pattern image on the recording medium.

* * * * *